United States Patent [19]

Hirano

[11] Patent Number: 4,549,505

[45] Date of Patent: Oct. 29, 1985

[54] COOLING SYSTEM FOR AUTOMOTIVE ENGINE OR THE LIKE

[75] Inventor: Yoshinori Hirano, Yokohama, Japan

[73] Assignee: Nissan Motor Co., Ltd., Yokohama, Japan

[21] Appl. No.: 663,911

[22] Filed: Oct. 23, 1984

[30] Foreign Application Priority Data

Oct. 25, 1983 [JP] Japan ..... 58-199864
Oct. 26, 1983 [JP] Japan ..... 58-198970

[51] Int. Cl.[4] ..... F01P 3/22

[52] U.S. Cl. ..... 123/41.08; 123/41.21; 123/41.27

[58] Field of Search ..... 123/41.02, 41.2, 41.21, 123/41.27, 41.08, 41.09, 41.1, 41.54

[56] References Cited

U.S. PATENT DOCUMENTS 3,425,400 2/1969 Scherenberg ..... 123/41.08
4,362,131 12/1982 Mason et al. ..... 123/41.1
4,473,037 9/1984 Michassouridis et al. ..... 123/41.27

FOREIGN PATENT DOCUMENTS 4317136 3/1960 Japan ..... 123/41.02
WO80/863 5/1980 PCT Int'l Appl. ..... 123/41.02

*Primary Examiner*—William A. Cuchlinski, Jr.
*Attorney, Agent, or Firm*—Schwartz, Jeffery, Schwaab, Mack, Blumenthal & Evans

[57] ABSTRACT

In order to minimize the size of an auxiliary coolant reservoir and to ensure that the appropriate control is executed over the system during all phases of engine operation, a control circuit including a microprocessor is arranged to selectively induce a non-condensible purge mode, cold start mode, normal operation mode, overcooled mode and a system shut-down mode. The latter mentioned mode allows for the coolant to cool down before the system is switch from closed to open states and minimizes the tendancy for coolant to be displaced from the system in large quantities under the influence of a positive pressure which tends to prevail at the time the engine is stopped. Control of the various modes is facilitated by a valve/conduiting arrangement which features three basic conduits each of which include one ON/OFF type electromagnetic valve.

7 Claims, 16 Drawing Figures

(NORMAL OPERATION MODE)

(NON-CONDENSIBLE MATTER PURGE MODE)

(OVERCOOLED CONTROL MODE)

COOLING SYSTEM FOR AUTOMOTIVE ENGINE OR THE LIKE

BACKGROUND OF THE INVENTION

1. Field of the Invention

The present invention relates generally to a cooling system for an internal combustion engine wherein liquid coolant is boiled to make use of the latent heat of vaporization of the same and the vapor used as vehcile for removing heat from the engine, and more specifically to such a system which includes a control system which enables simple precise control of the operation of same and which includes means via which undesirable overcooling of the system due to external influences can be prevented.

2. Description of the Prior Art

In currently used "water cooled" internal combustion engines such as shown in FIG. 1 of the drawings, the engine coolant (liquid) is forcefully circulated by a water pump, through a circuit including the engine coolant jacket and an air cooled radiator. This type of system encounters the drawback that a large volume of water is required to be circulated between the radiator andthe coolant jacket in order to remove the required amount of heat. Further, due to the large mass of water inherently required, the warm-up characteristics of the engine are undesirably sluggish. For example, if the temperature difference between the inlet and discharge ports of the coolant jacket is 4 degrees, the amount of heat which 1 Kg of water may effectively remove from the engine under such conditions is 4 Kcal. Accordingly, in the case of an engine having 1800 cc displacement (by way of example) is operated at full throttle, the cooling system is required to remove approximately 4000 Kcal/h. In order to acheive this a flow rate of 167 Liter/min (viz., $4000-60\times\frac{1}{4}$) must be produced by the water pump. This of course undesirably consumes a number of otherwise useful horsepower.

FIG. 2 shows an arrangement disclosed in Japanese patent application Second Provisional Publication No Sho 57-57608. This arrangement has attempted to vaporize a liquid coolant and use the gaseous form thereof as a vehicle for removing heat from the engine. In this system the radiator 1 and the coolant jacket 2 are in constant and free communication via conduits 3, 4 whereby the coolant which condenses in the radiator 1 is returned to the coolant jacket 2 little by little under the influence of gravity.

This arrangement has suffered from the drawbacks that the radiator, depending on its position with respect to the engine proper tends to be at least partially filled with liquid coolant. This greatly reduces the surface area via whch the gaseous coolant (for example steam) can effectively release its latent heat of vaporization and accordingly condense and thus has lacked any notable improvement in cooling efficiency.

Further, with this system in order to maintain the pressure whithin the coolant jacket and radiator at atmospheric level, a gas permeable water shedding filter 5 is arranged as shown, to permit the entry of air into and out of the system. However, this filter permits gaseous coolant to gradually escape from the system, inducing the need for frequent topping up of the coolant level.

A further problem with this arrangement has come in that some of the air, which is sucked into the cooling system as the engine cools, tends to dissolve in the water, whereby upon start up of the engine, the dissolved air tends to form small bubbles in the radiator which adhere to the walls thereof forming an insulating layer. The undisolved air tends to collect in the upper section of the radiator and inhibit the convention-like circulation of the vapor from the cylinder block to the radiator. This of course further deteriorates the performance of the device.

European patent application Provisional Publication No. 0 059 423 published on Sept. 8, 1982 discloses another arrangement wherein, liquid coolant in the coolant jacket of the engine, is not circulated therein and permitted to absorb heat to the point of boiling. The gaseous coolant thus generated is adiabatically compressed in a compressor so as to raise the temperature and pressure thereof and introduced into a heat exchanger. After condensing, the coolant is temporarily stored in a reservoir and recycled back into the coolant jacket via a flow control valve.

This arrangement has suffered from the drawback in that air tends to leak into the system upon cooling thereof. This air tends to be forced by the compressor along with the gaseous coolant into the radiator. Due to the difference in specific gravity, the air tends to rise in the hot environment while the coolant which has condensed moves downwardly. The air, due to this inherent tendency to rise, forms large bubbles of air which cause a kind of "embolism" in the radiator and badly impair the heat exchange ability thereof.

U.S. Pat. No. 4,367,699 issued on Jan. 11, 1983 in the name of Evans (see FIG. 3 of the drawings) discloses an engine system wherein the coolant is boiled and the vapor used to remove heat from the engine. This arrangement features a separation tank 6 wherein gaseous and liquid coolant are initially separated. The liquid coolant is fed back to the cylinder block 7 under the influence of gravity while the "dry" gaseous coolant (steam for example) is condensed in a fan cooled radiator 8. The temperature of the radiator is controlled by selective energizations of the fan 9 to maintain a rate of condensation therein sufficient to maintain a liquid seal at the bottom of the device. Condensate discharged from the radiator via the above mentioned liquid seal is collected in a small reservoir-like arrangement 10 and pumped back up to the separation tank via a small pump 11.

This arrangement, while providing an arrangement via which air can be initially purged from the system tends to, due to the nature of the arrangement which permits said initial non-condensible matter to be forced out of the system, suffers from rapid loss of coolant when operated at relatively high altitudes. Further, once the engine cools air is relatively freely admitted back into the system. The provision of the separation tank 6 also renders engine layout difficult.

Japanese patent application First Provisional Publication No. Sho. 56-32026 (see FIG. 4 of the drawings) discloses an arrangement wherein the structure defining the cyclinder head and cylinder liners are covered in a porous layer of ceramic material 12 and coolant sprayed into the cylinder block from shower-like arrangements 13 located above the cylinder heads 14. The interior of the coolant jacket defined within the engine proper is essentially filled with gaseous coolant during engine operation during which liquid coolant sprayed onto the ceramic layers 12. However, this arrangement has proved totally unsatisfactory in that upon boiling of the liquid coolant absorbed into the ceramic layers the vapor thus produced escaping into the coolant jacket inhibits the penetration of liquid coolant into the layers whereby rapid overheat and thermal damage of the ceramic layers 12 and/or engine soon results. Further, this arrangement is plagued with air contamination and blockages in the radiator similar to the compressor equipped arrangement discussed above.

In summary although the basic concepts of open and closed "vapor cooling" systems wherein the coolant is boiled to make use of the latent heat of evaporation thereof and condensed in a suitalbe heat exchanger, is known, the lack of a control system which is both sufficiently simple as to allow practical use and which overcomes the various problems plauging the prior art is wanting.

SUMMARY OF THE INVENTION

It is an object of the present invention to provide a cooling system for an internal combustion engine wherein the adequate control can be executed over the operation of the system under all modes of operation including those during which excessively low internal pressures which tend to crush components of the system or induct excessive amounts of contaminating air into the system, are induced by uncontrollable external influences, (such as low ambient temperatures etc.,) and whereby any noncondensible matter which finds its way into the system can be readily removed.

A further object of the present invention is to provide a cooling system which features a control which enables the reduction in size of auxiliary devices such as a coolant reservoir.

In brief, the above objects are achieved via and arrangement wherein in order to minimize the size of an auxiliary coolant reservoir and to ensure that the appropriate control is executed over the system during all phases of engine operation, a control circuit including a microprocessor is arranged to selectively induce:

a non-condensible purge mode—wherein excess coolant is pumped into the cooling system to the point of overfilling same and thus displacing any air or like noncondensible matter;

a cold start mode—wherein the coolant and engine are rapidly warmed due to the system being completely filled with liquid coolant (which inhibits heat exchange with the ambient atmosphere) and wherein the vapor produced by the heating used to displace excess coolant from the system until the amount required for normal operation remains;

a normal operation mode—wherein the temperature of the engine is controlled by controlling the rate of condensation of vapor (generated in the coolant jacket) in the radiator;

an overcooled control mode—wherein the radiator is partially filled with liquid coolant in order to reduce the effective heat exchange surface area thereof and thus prevent excessively low temperatures and pressures from prevailing within the system; and a system shut-down mode—wherein the coolant temperature and pressure within the system are allowed to fall to eliminate any positive pressure which tends to displace overly large amounts of coolant out of the system to an externally disposed coolant reservoir, upon the system being switched from a closed state to an open one.

The latter mentioned mode allows the size of the reservoir to be minimized. Control of the various modes is facilitated by a valve/conduiting arrangement which features three basic conduits each of which include one ON/OFF type electromagnetic valve.

More specifically, the present invention takes the form of an internal combustion engine which has a combustion chamber and which features: a radiator; a coolant jacket in which coolant is boiled and the vapour produced fed to the radiator for condensation therein; a reservoir containing coolant; a first conduit leading from the radiator to the coolant jacket, the first conduit including a pump for returning liquid coolant from the radiator the the coolant jacket and a first valve, the first valve having a open position wherein fluid can flow therethrough and a closed position wherein fluid is prevented from passing therethorugh to the coolant jacket; a second conduit which communicates with the reservoir at one one end thereof and which communicates with the coolant jacket at the other end thereof, the second conduit including a second valve having an open position and a closed position; a third conduit which communicates at one end thereof with the reservoir and which communicates at the other end thereof with one of said radiator and the first conduit at a location between the pump and the radiator, the third conduit including a third valve, the third valve having an open position and a closed position; and a control circuit for controlling the operation of the pump, first, second and third valves.

BRIEF DESCRIPTION OF THE DRAWINGS

The features and advantages of the arrangement of the present invention will become more clearly appreciated from the following description taken in conjunction with the accompanying drawings in which.

DETAILED DESCRIPTION OF THE PREFERRED EMBODIMENTS

Figure 1:
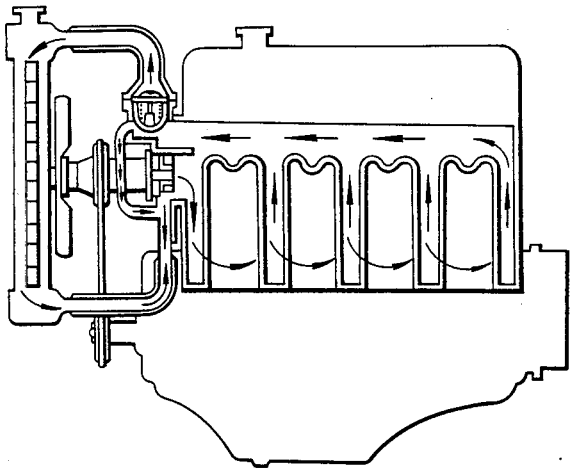
FIG.1 (PRIOR ART)
FIG. 1 is partially sectioned elevation showing a currently used conventional water circulation type systems discussed in the opening paragraphs of the instant disclosure.
Figure 2:
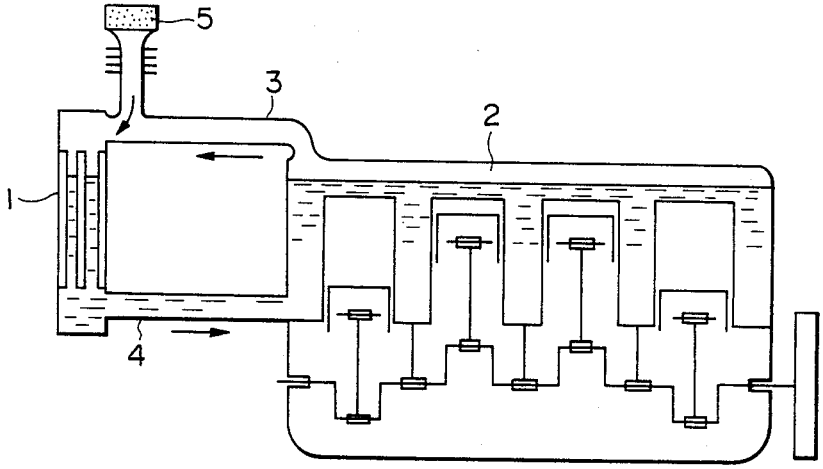
FIG.2 (PRIOR ART)
FIG. 2 is a schematic side sectional elevation of an prior art arrangement also discussed briefly in the earlier part of the specification.
Figure 3:
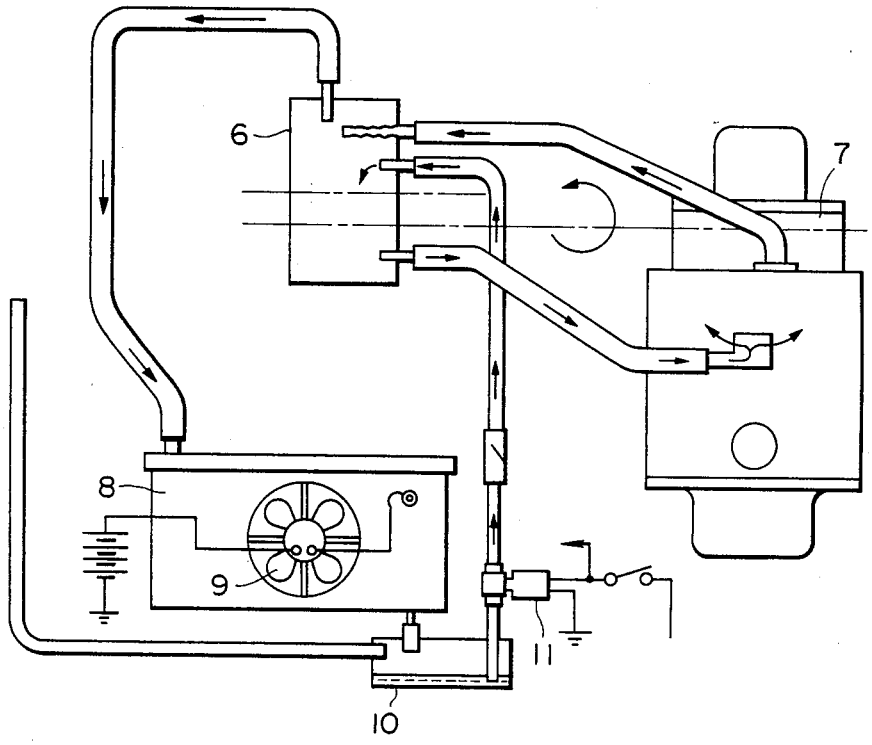
FIG. 3 (PRIOR ART)
FIG. 3 shows in schematic layout form, another of the prior art arrangements previously discussed.
Figure 4:
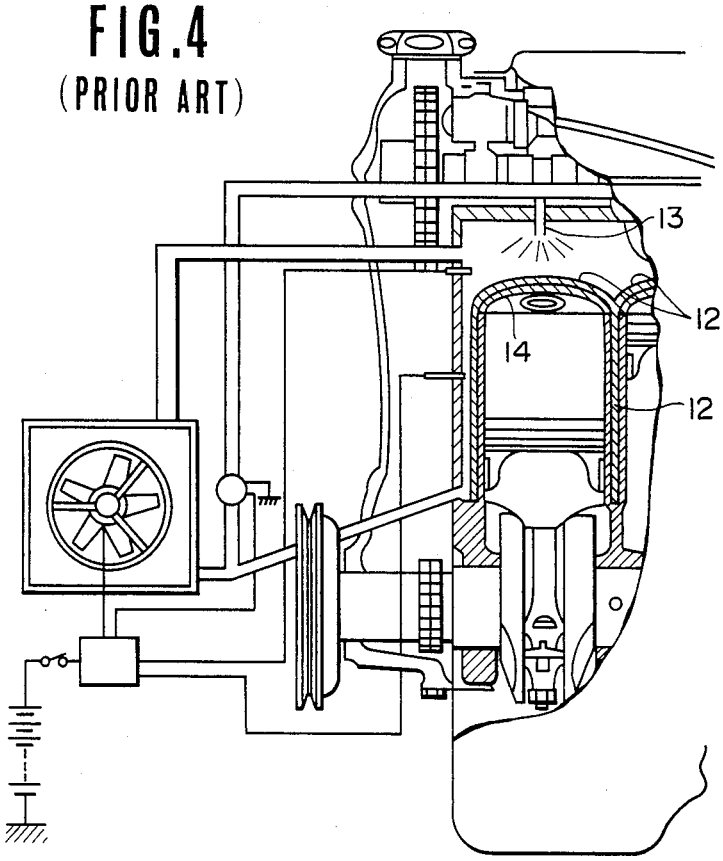
FIG.4 (PRIOR ART)
FIG. 4 shows in partial section yet another of the previously discussed prior art arrangements.

FIGS. 6 to 9 show an engine system incorporating a first embodiment of the present invention. In this arrangement, an internal combustion engine 100 includes a cylinder block 106 on which a cylinder head 104 is detachably secured. The cylinder head 104 and cylinder block 106 include suitable cavities which define a coolant jacket 120 about the heated portions of the cylinder head and block.

Fluidly communicating with a vapor discharge port 124 of the cylinder head 104 is a radiator or heat exchanger 126. It should be noted that the interior of this radiator 126 is maintained essentially empty of liquid coolant during normal engine opertion so as to maximize the surface area available for condensing coolant vapor (via heat exchange with the ambient atmosphere) and that the cooling system as a whole (viz., the system emcompassed by the coolant jacket, radiator and conduiting interconnecting same) is hermetically closed when the engine is warmed-up and running. These features will become clearer as the discription proceeds.

If deemed advantageous a mesh screen or like separator (not shown) can be disposed in the vapor discharge port 124 of the cylinder head so as to minimize the transfer of liquid coolant which tends to froth during boiling, to the radiator 126.

Located suitably adjacent the radiator 126 is a electrically driven fan 127. Defined at the bottom of the radiator 126 is a small collection reservoir or lower tank 128 as it will be referred to hereinafter. Disposed in the lower tank 128 is a level sensor 130 which is adapted to output a signal indicative of the level of liquid coolant in the lower tank 128 being above a level selected to be just lower than the lower ends of the tubing which consitute the radiator per se.

Leading from the lower tank 128 to the cylinder block 120 is a return conduit 132. As shown, an ON/-OFF type electromagnetic valve 134 and a relatively small capacity return pump 136 are disposed in the conduit 132. The valve 134 is located upstream of the pump 136. The return conduit 132 is arranged to communicate with the lowermost portion of the coolant jacket 120.

In order to sense the level of coolant in the coolant jacket, a level sensor 140 is disposed as shown. It will be noted that this sensor is arranged at a level higher than that of the combustion chambers, exhaust ports and valves (structure subject to high heat flux) so as to enable same to be securely immersed in coolant and thus attenuate any engine knocking and the like which might otherwise occur due to the formation of localized zones of abnormally high temperature or "hot spots".

Located below the level sensor 140 so as to be immersed in the liquid coolant is a temperature sensor 144.

A coolant reservoir 146 is located beside the engine proper as shown. An air permeable cap 148 is used to close the reservoir 146 in a manner that atmospheric pressure continuously prevails therein.

The reservoir 146 fluidly communicates with the engine coolant jacket 120 via a displacement or dishcarge conduit 150 and an ON/OFF type electromagnetic valve 152. This valve is closed when energized. As shown, the conduit 150 communicates with the coolant jacket at essentially the same level as return conduit 132.

A supply conduit 154, part of which is common with conduit 150, established fluid communication between the reservoir 146 and the return conduit 132 at a location intermediate of the valve 134 and the pump 136. An ON/OFF type valve 156 is disposed in this conduit as shown. This valve 156 is closed when energized.

A third coolant level sensor 160 is disposed in a riser-like portion 162 of the cylinder head 104. This sensor 160 is located immediately below a cap 164 which hermetically closes the riser 162. Located immediately adjacent the third level sensor 160 is a "purge" port 166. This port 166, as shown, communicates with the reservoir 164 via an overflow conduit 168. A normally closed electromagnetic valve 170 is disposed in the overflow conduit 168. This valve is opened when energized.

The above mentioned level sensors 130, 140 & 160 may be of any suitable type such as float/reed switch types.

As shown, the outputs of the level sensors 130, 140 & 160, and temperature sensor 144 are all fed to a control circuit 180. In this embodiment the control circuit 180 includes therein a microprocessor including input and output interfaces I/O a CPU, a RAM and a ROM. Suitable control programs are set in the ROM and are used to control the operation of the valves 134, 152, 156 & 170 and fan 127 in response to the various data supplied thereto.

Prior to initial use the cooling system is filled to the brim with coolant (for example water or a mixture of water and antifreeze or the like) and the cap 164 securely set in place to seal the system. A suitable quantity of additional coolant is also poured into the reservoir 146. Although at this time by using de-aerated water when initially filling the system and reservoir, the system is essentially free of contaminating air etc., over a period of time noncondensible matter will find its way into the system. For, example the water (coolant) in the reservoir will tend to absorb atmospheric air and each time the system is filled with coolant (explantion given in detail later) a little non-condensible matter will tend to find its way into the system. Further, during given modes of engine operation slightly negative pressures develop and although the system is operating is a sealed or closed mode at the time, air, little by little, tends to leak into the system via the gasketing and the like defined between the cylinder head and cylinder block and between the seals defined between conduiting and associated elements of the system.

Accordingly, upon start up of the engine it is firstly necessary to survey the status of the system and determine if it is necessary to purge out noncondensibl matter, proceed into a warm up or cold start mode or proceed into a warm start mode of operation.

Figure 10:
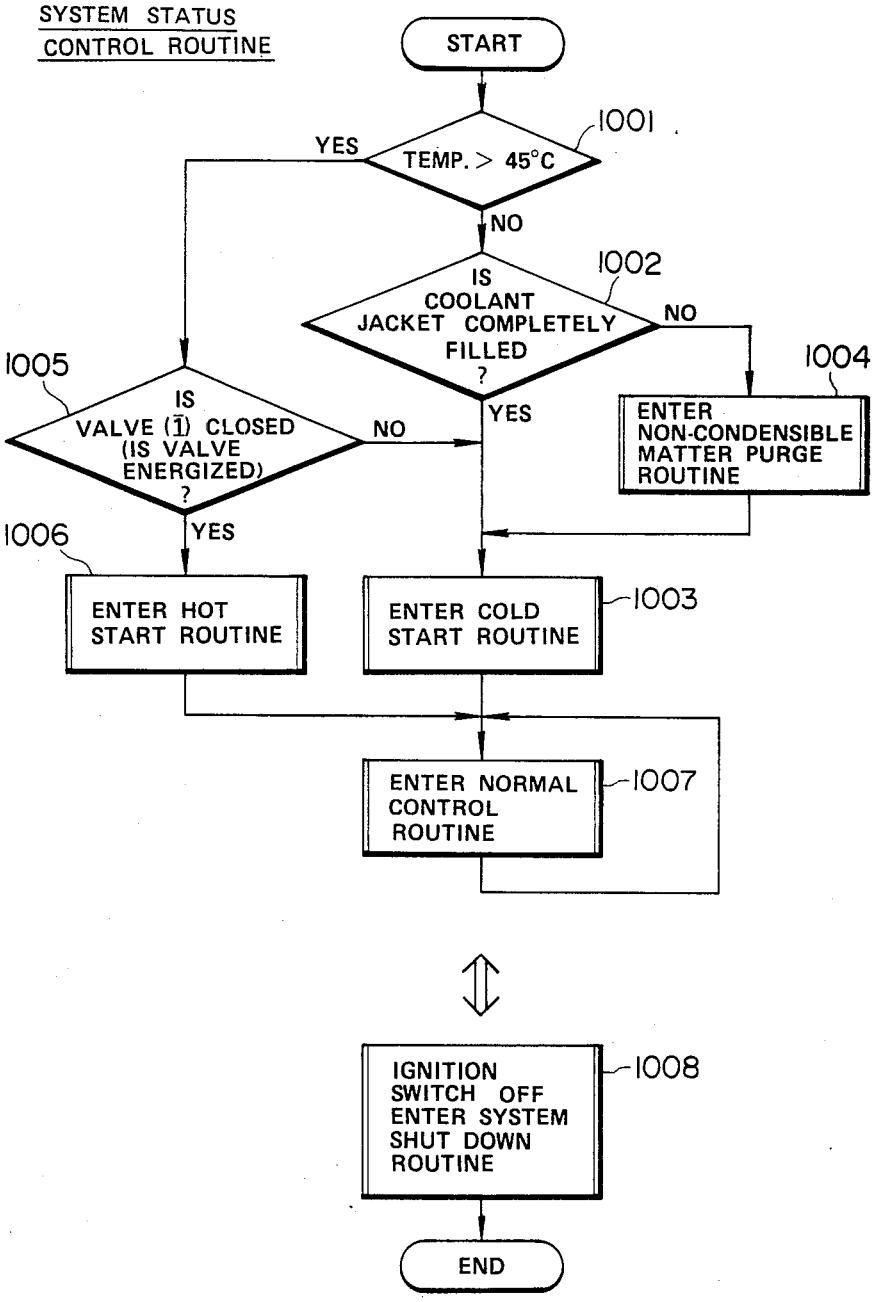
FIG. 10 is a flow chart showing a system status control routine which forms a vital part of the instant invention.

To the above end the microcomputer of control circuit 180 is arranged to execute a system status review control routine, the characterizing steps of which are illustrated in the flow chart of FIG. 10, upon engine starting.

As shown, subsequent to START a determination is made at step 1001 as to whether the temperature of the coolant is above a predetermined level. In this instance the temperature is selected to be 45° C. It should be appreciated that this value is merely an exemplary one and can be varied as required (e.g. to meet various climatic variations). If the outcome of this enquiry is NO, indicating the temperature of the coolant is below 45° C. and the engine is "cold", then the program proceeds to step 1002, wherein a determination is made by sampling the output of level sensor 160 to determine if the level of the coolant is at the required one (viz., the system is completely filled with liquid coolant. If the output of level sensor 160 indicates that the system is completely filled, the program proceeds to step 1003 wherein a cold start routine is implemented. However, if some non-condensible matter has collected in the riser 162, the the program proceeds to step 1004 and implements a non-condensible matter purge routine.

On the other hand, if the outcome of the enquiry made at step 1001 indicates that the temperature is above 45° C., that is to say the engine has only recently been stopped and is still warm, the program proceeds to determine at step 1005, if the valve 156 (I) is closed (viz., energized) and the system in an "closed" condition. If the outcome of this enquiry is YES (viz., the system is in a closed state then the program proceeds to step 1006 wherein a hot start routine is implemented. However, if the outcome is NO and the system is in an "open" state then the program proceeds to step 1003.

Upon completion of the non-condensible matter purge routine the system status control program resumes and proceeds to step 1003 to implement a cold start routine while subsquent to steps 1003 and 1006, viz, the completion of the cold start and hot start routines, respectively, the program goes on to enter the normal operation routine (step 1007).

If the engine is stopped at any point of the system status control routine or any of the sub routines integrated therewith, the control circuit immediately implements a system shut-down routine (step 1008) subsequent to which the program ends.

Figure 11:
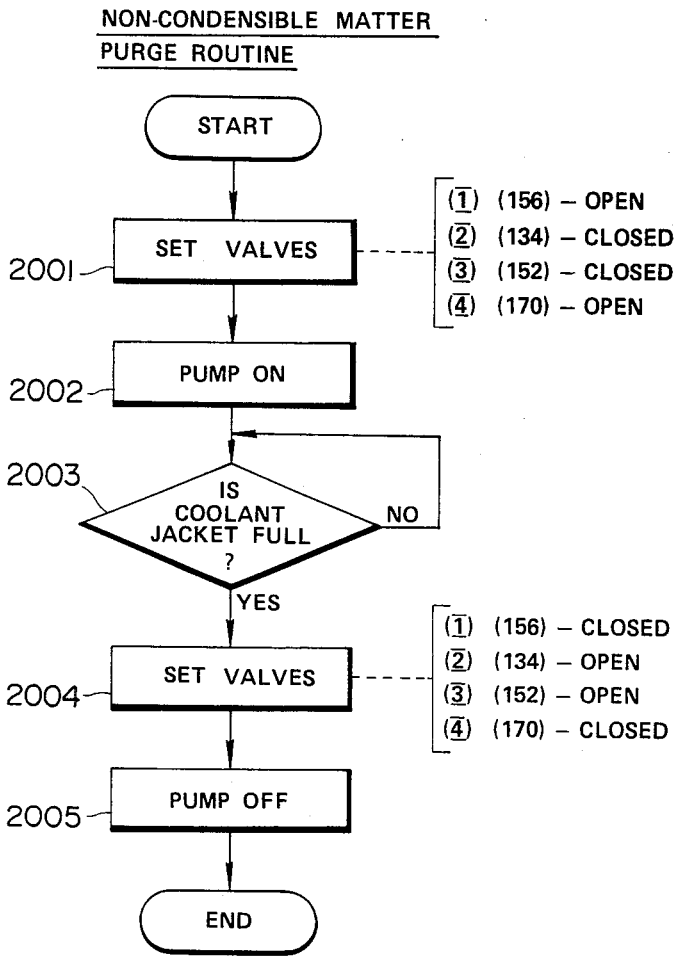
FIGS. 11 and 16 are flow charts which show the sub-routines which are included in the control routine shown in FIG. 10.

FIG. 11 is a flow chart illustrating the steps which characterize the above mentioned noncondensible matter purge routine. As shown, subsequent to the start of the program valves are conditioned so that valves 156 & 170 are open, while valves 134 & 152 are closed (step 2001). For the simplication of explanation valves 156, 134, 152 & 170 will be assigned additional reference signs (1), (2), (3) and (4) which will be used throughout the flow charts (and disclosure relating thereto) of FIGS. 10 to 16. For additional clarity these additional signs are used in FIGS. 7–9. In a similar manner, level sensors 130, 140 and 160 will be additionally labelled with (I), (II) and (III), respectively.

The above mentioned valve setting, conditions the system in manner the fluid communication is permitted betwen the reservoir 146 and the coolant jacket 120 via pump 136 and between the coolant jacket 120 and the reservoir 146 via the overflow conduit 168. Accordingly, when the pump 136 is energized at step 2002, coolant is inducted via conduits 150 (154), 154 and 132 and introduced into the coolant jacket 120. At step 2003 the enquiry is made as to whether the coolant jacket (and radiator) are completely full or not. This of course is done by sampling the output of sensor 160 (III). Thus, until the coolant jacket is completely filled, the pump is maintained in an energized state and continues to force coolant from the reservoir 146 into the coolant jacket 120. Upon the level of coolant rising above sensor 160 (III) the program proceeds to step 2004 wherein the valves are conditioned as shown. That is to say, valves 134 and 152 are opened while valves 156 and 170 are closed. This conditions the system for the cold start control mode. Following step 2004 the pump is stopped (step 2005) and the purge routine terminates.

Figure 12:
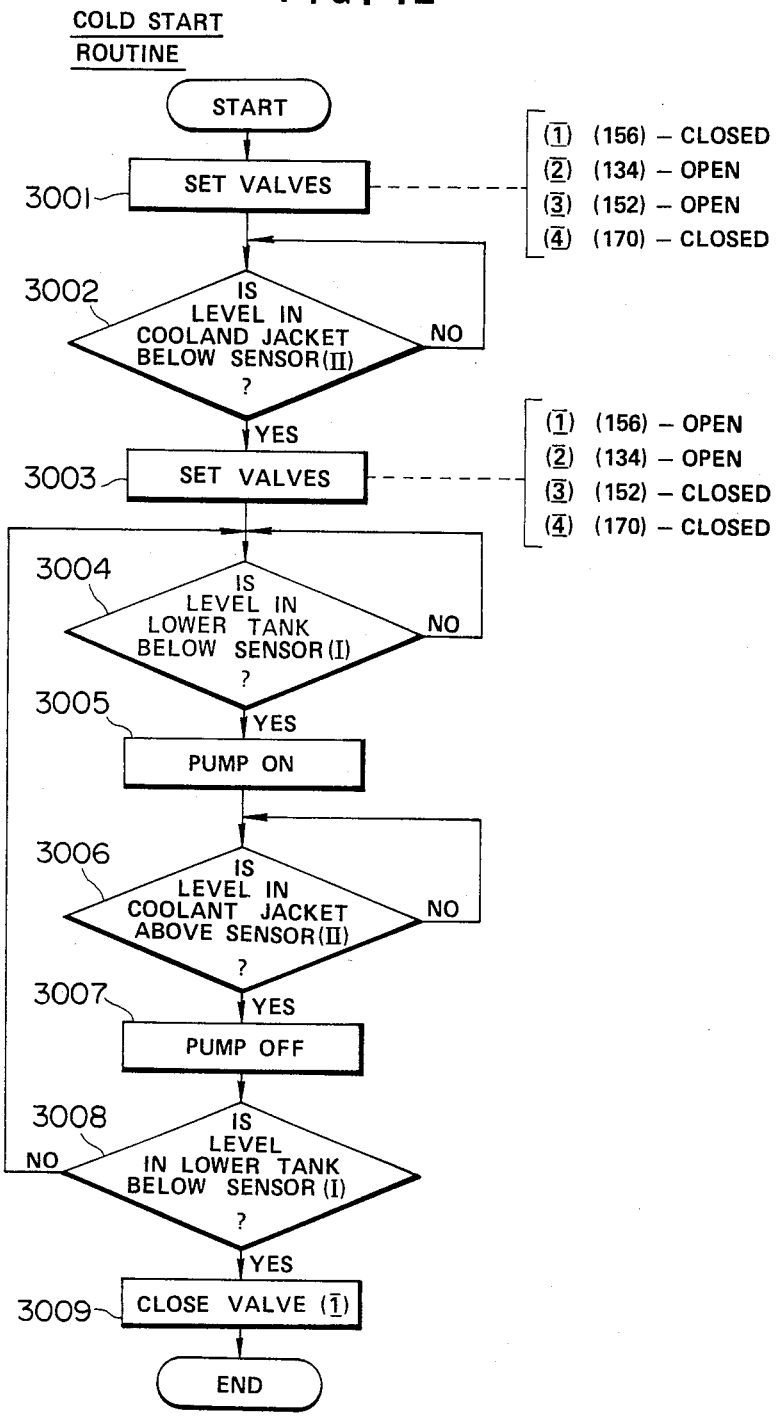

FIG. 12 shows the steps which characterize the cold start mode of control. At step 3001 of this flow chart, the valves are conditioned in manner identical with that induced during step 2004 of the purge routine. This step of course is necessary in case the purge routine is not run. At step 3002 the enquiry is carried out to determine whether the coolant level in the coolant jacket is at that of level sensor 140. If not, then the program recycles until due to the operation of the engine the coolant warms and produces sufficient vapor pressure to gradually displace the liquid coolant in both of the coolant jacket and radiator out through valve 152 and conduit 150 (154) to the reservoir 146 until it falls to that of level sensor 140.

It will be noted that during this mode of operation, as the "dry" surface area of the radiator 126 which is available for transfering heat to the ambient atmosphere is very small the amout of heat is removed from the engine is very small and accordingly, the engine rapidly warms-up. This of course notably speeds up the displacement of coolant which characterizes the cold start mode.

Upon the level sensor 140 (II) indicating that the level of the coolant has been displaced down to the level at which it switches, the program proceeds to step 3003 whereat valve 152 is de-energized and allowed to close and further conditions valves 156 and 134 to assume open states (viz., both assume de-energized) states. Under these conditions, the excess coolant is discharged from the system (in particular from the radiator 126 via conduit 132, valve 134, conduit 154 and valve 156; it being noted that if the pump 136 is not energized then a relatively high flow restriction occurs thereacross.

Subsequently, at step 3004 the enquiry is made as to whether the coolant level is below that of sensor 140. If the answer is positive (YES), then pump 136 is energized (step 3005) to induct coolant from the radiator 126 (partially full) and pump same into the coolant jacket 120. This maintains the appropriate level of coolant within the coolant jacket 120 while draining the radiator. That is to say, the excess coolant in the radiator is both forced out of the system by the rising vapor pressure as well as being pumped therefrom into the coolant jacket by pump 136.

At step 3006 the enquiry as to whether the coolant level is below the level of sensor 140. In the answer is NO the pump is maintaind in an energized state. On the other hand, if the level is above that of sensor 140 (II) then the pump is stopped (step 3007). At step 3008 it is determined if the coolant level has fallen to that of level sensor 130 (I) or not. That is to say, it is determined if the radiator 126 has been emptied of liquid coolant. If the outcome of this enquiry is NO then the program recycles to step 3004. This situation is maintaied until the enquiry performed at step 3008 indicates that the level of the liquid coolant has fallen to that of level sensor 130 (I) whereupon valve 156 (1) is energized and thus closed (step 3009). This places the system in a completely "closed" condition and the cold start routine terminates.

Figure 13:
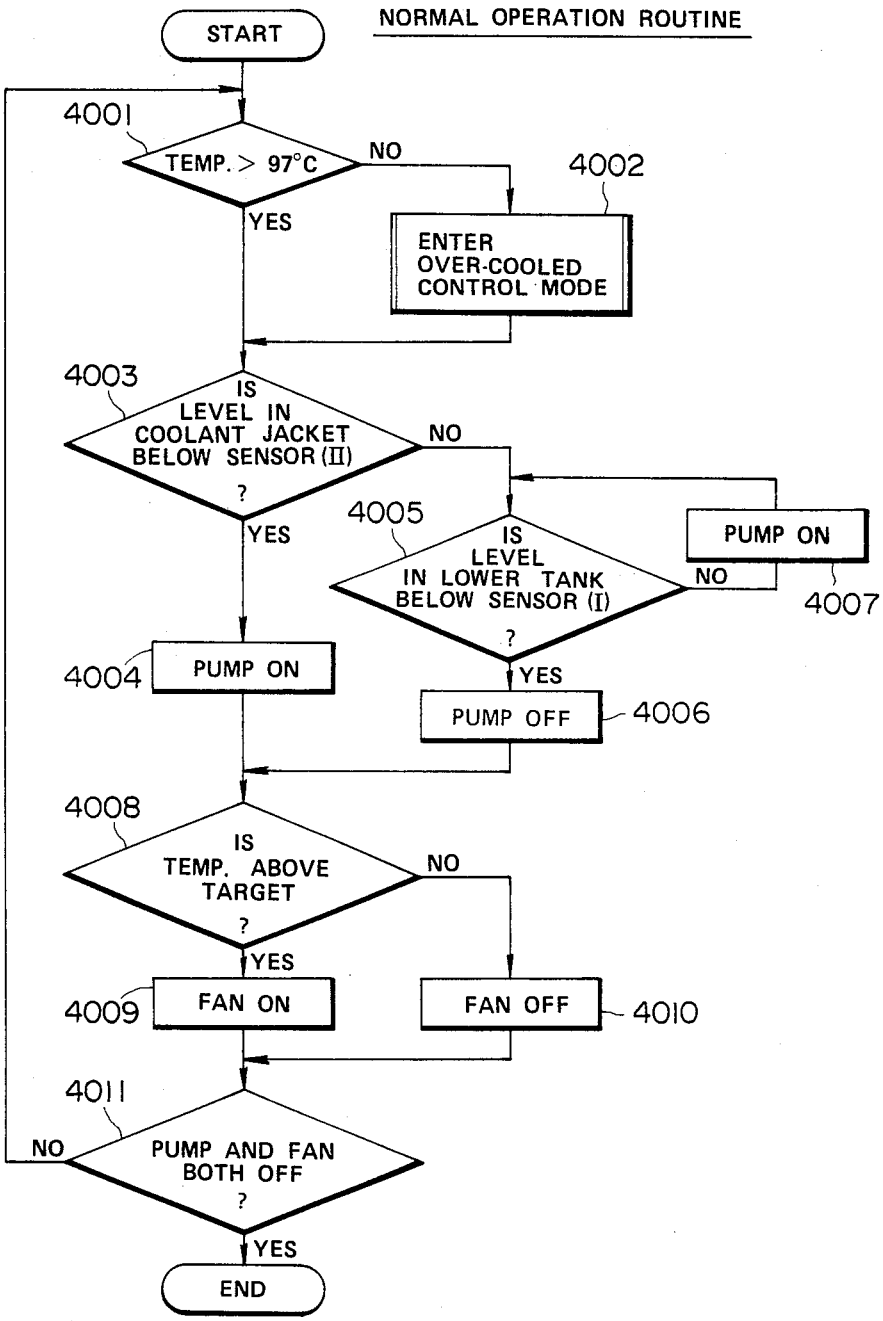

FIG. 13 shows the steps which characterize the normal operation routine. In this control mode it is necesary to ensure that the pressure within the system is, in particular, prevented from dropping to levels whereat air tends to be inducted into the system or crushing of some of the elements constituting the system occurs. Thus at step 4001, it is determined if the temperature of the coolant greater than a predetermined minimum level. In this case 97° C. by way of example. If the outcome of this determination reveals that the temperature is below the minimum allowable level then the program program proceeds to step 4002 wherein the overcooled control routine is implemented. However, if the temperature of the coolant is above 97° C. then the program goes on step 4003 wherein it is ascertained if the coolant level is lower than that of second 140 (II).

If the level in the coolant jacket has fallen below the required level due to the boiling off of same, the pump is energized to introduce additional coolant (step 4004). However, if the level is not lower than that of sensor 140 (II) then it is determined (step 4005) if the level of liquid coolant in the lower tank 128 is below that of sensor 130 (I). If the level is lower, then the pump is stopped (step 4006). However, if the level is above that of the sensor then the pump is switched on (step 4007) to reduce the level in the lower tank and thus ensure that the interior of the radiator 126 is maintained in an essentially "dry" state and thus exhibit its maximum heat exchange efficiency. As the appropriate amount of coolant was retained in the system during the cold start mode there is no fear of any particular imbalance in the distribution of the coolant via the implementation of steps 4003 to 4007.

At step 4008 the enquiry is made as to whether the coolant temperature is above a target value. This value can be selected in view of a various operational parameters such as engine speed and engine load. Viz., under low load/engine speed conditions it is advantageous to raise the temperature of the engine coolant to promote thermal efficiency while during high engine speed/load operation lower temperatures are preferred in oder to ensure that an adequate amount of heat is removed from the engine under such conditions and thus ensure that knocking or engine seizure (for example) do not occur.

If the outcome of the enquiry performed in step 4008 indicates that the temperature is above the desired or target level then the fan 127 is energized (step 4009). On the other hand, if the temperature is lower than that required then the fan 127 is either not energized or switched off if energized (step 4010). At the next stage (step 4011) it is determined if both of the pump and fan are de-energized (viz., not in use). If in fact both of these units are not in use, then the program terminates. However, if either is energized, then the program recycles to step 4001.

Figure 5:
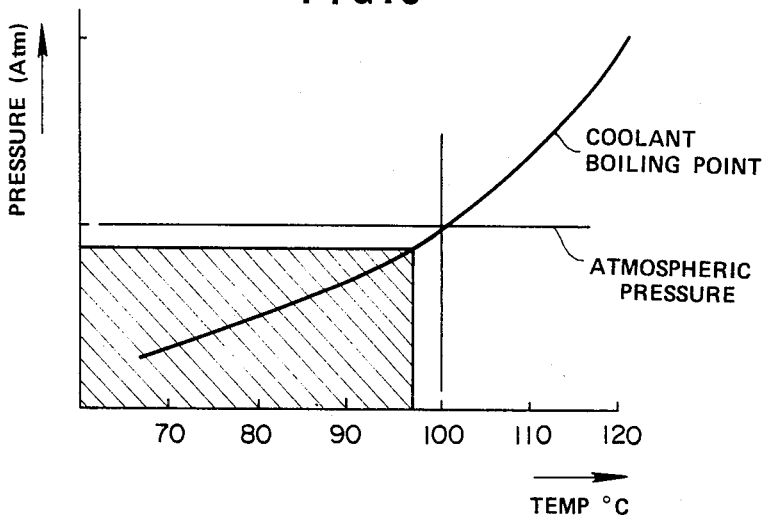
FIG. 5 is a graph showing in terms of pressure and temperature, the change which occurs in the coolant boiling point with change in pressure.
Figure 6:
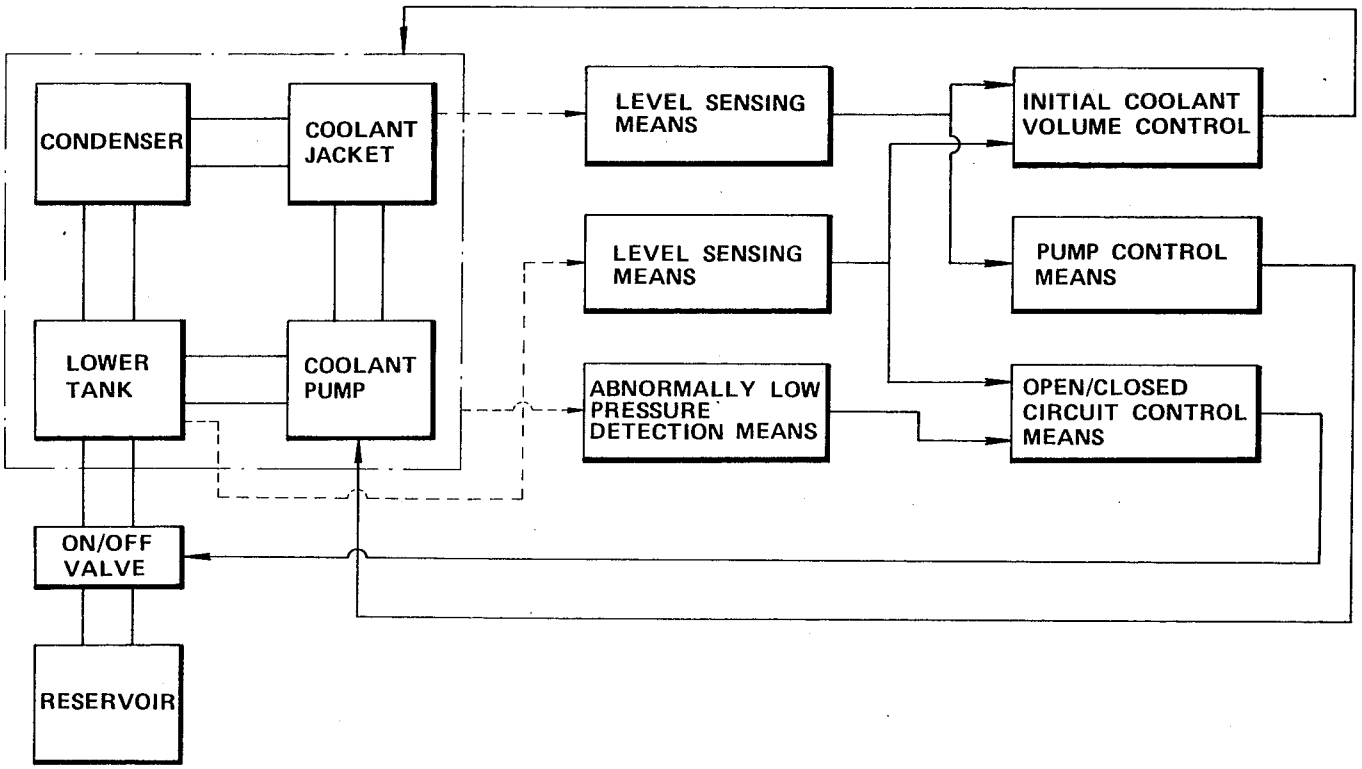
FIG. 6 shows in schematic block diagram form, the basic layout of the system according to the present invention.
Figure 7:
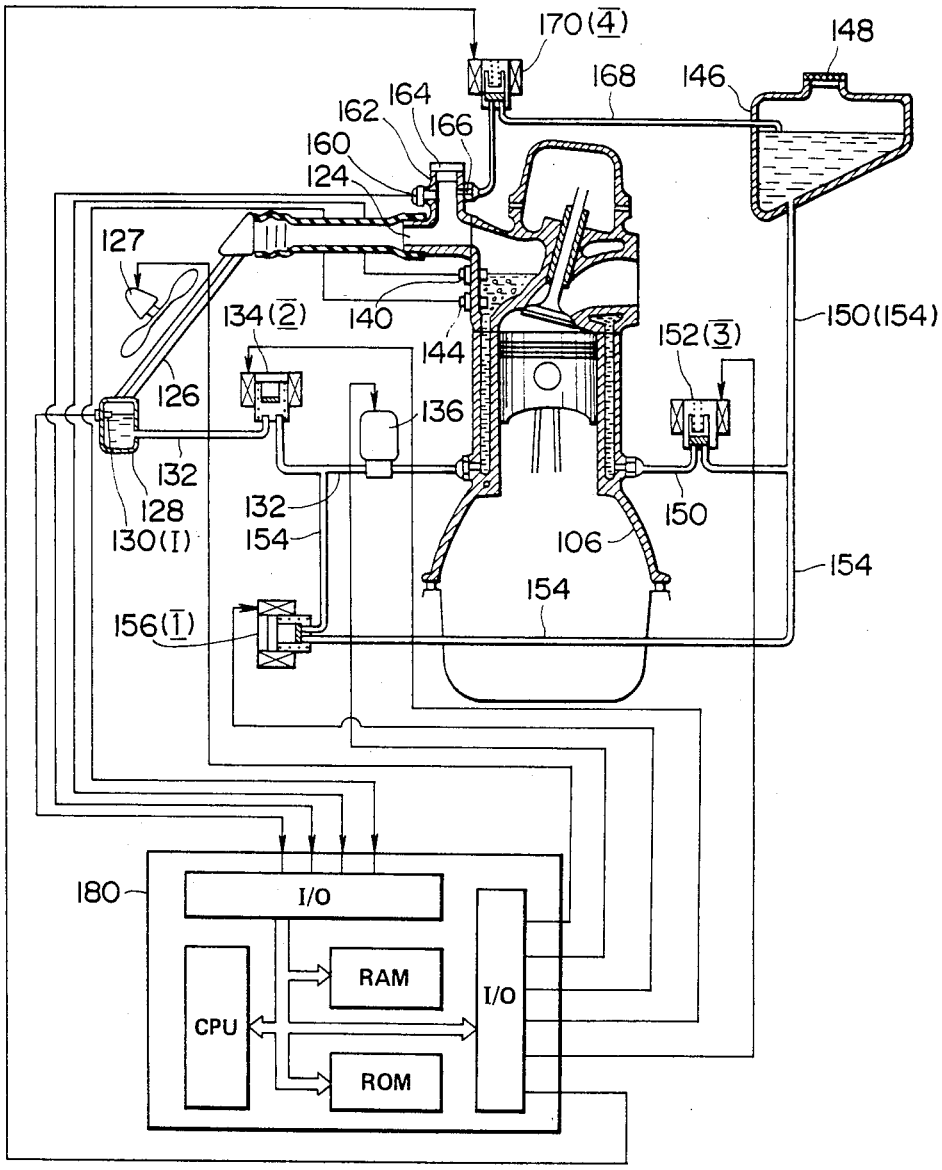
FIG. 7 shows in sectional elevation an engine system which embodies the present invention.
Figure 8:
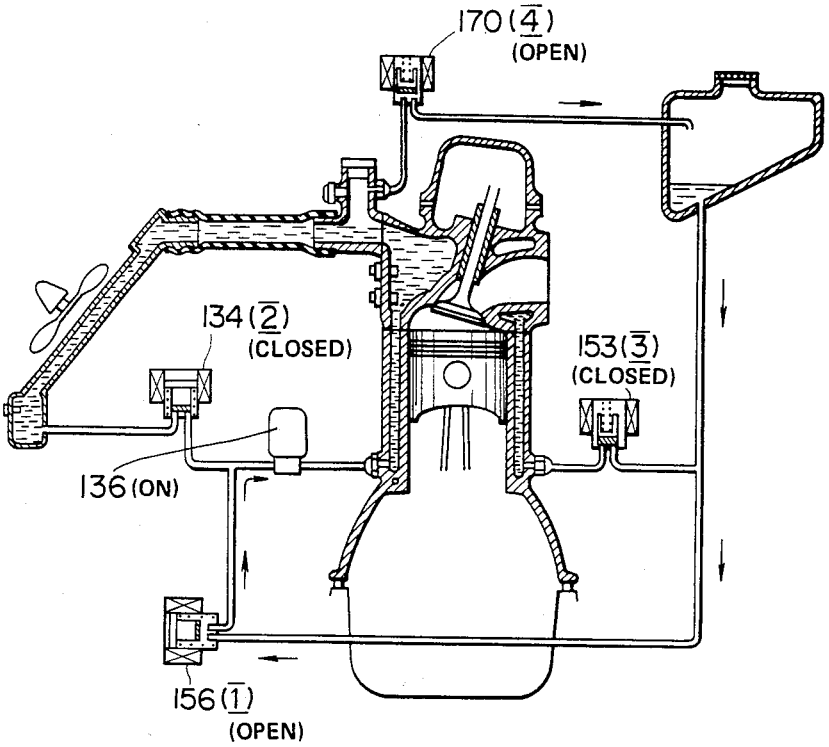
FIGS. 8 and 9 are view similar to that of FIG. 7 illustrating two of the various modes of operation of the engine system shown in FIG. 7.
Figure 9:
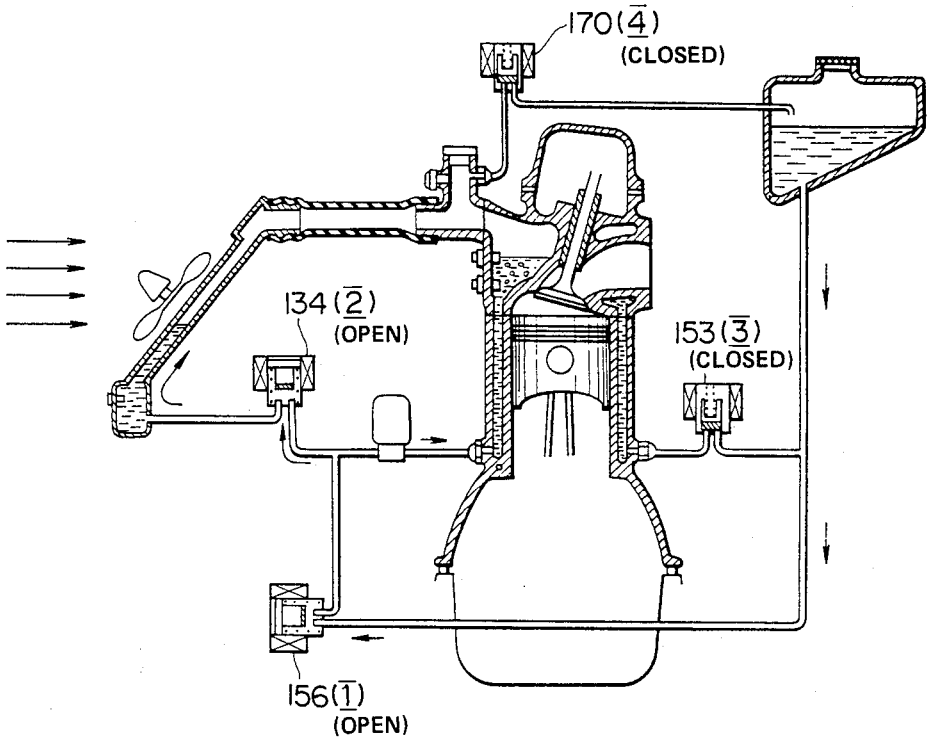
Figure 14:
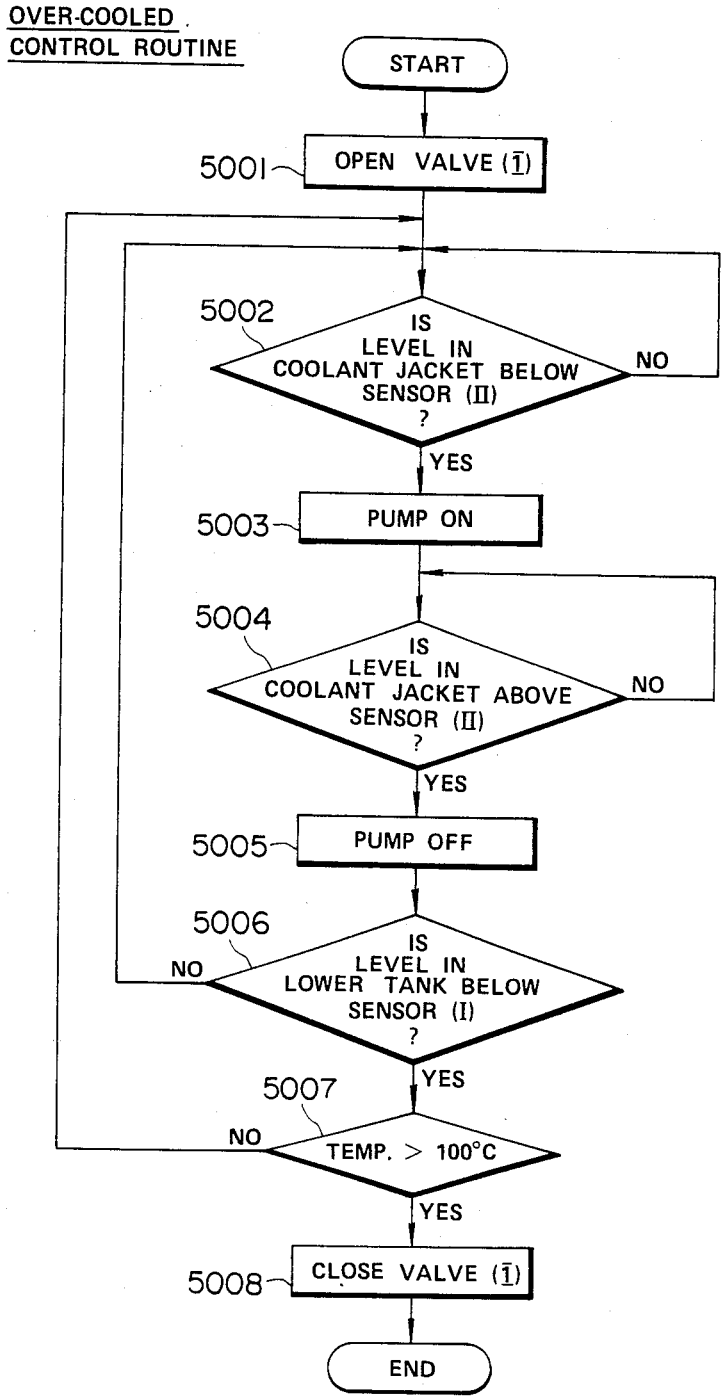
Figure 15:
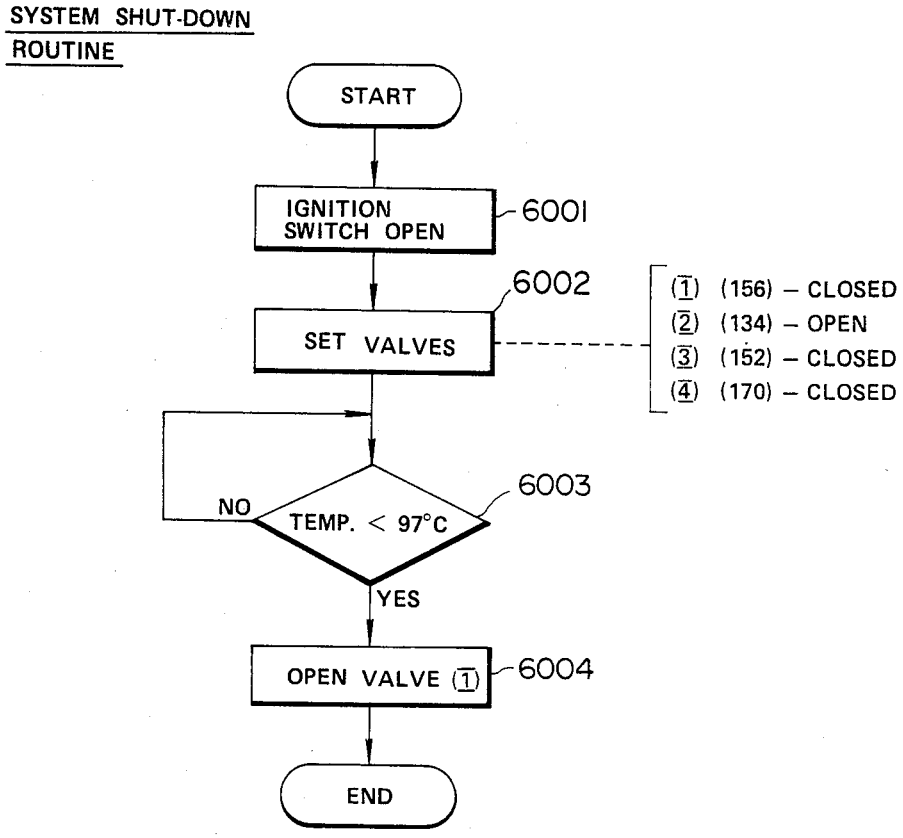

FIG. 14 shows the steps which characterize the overcooled control routine. As previously mentioned, it is possible that under extremely cold conditions, prolonged downhill coasting or the like, that the rate of condensation in the radiator 126 will exceed that required for the given mode of operation despite the non use of the fan, and lower the pressure prevailing in the system. Under these conditions, as shown in FIG. 5, if the system operates within the hatched zone the danger of conduiting and like being crushed by the external atmospheric pressure, arrises and measures must be taken to obviate this situation.

Accordingly, with this overcooled control routine, upon it being determined that the engine is operating with the coolant below the minimum allowable temperature (e.g. 97° C.)—(see step 4002 in the normal operatio routine)—then at step 5001 valve 156 (1) is opened via de-energization. Accordingly, as the system has now reverted to an "open" state, and as valve 134 (2) is also open the negative pressure which inherently prevails in the system under such conditions induces coolant to flow from the reservoir via conduits 154 and 132 and enter the lower tank 128. It will be noted that the coolant which is inducted under such conditions flows predominently inducted into the lower tank 128 and radiator 126 due to the flow resistance provided by the pump (when deenergized). This proceedure allows the coolant level to rise into the radiator until the negative pressure is negated. Simultaneously, the "dry" surface area of the radiator via which efficient heat exchange can take place is notably reduce thus reducing the amount of heat which may be moved from the system under such conditions and therefore increasing the temperature thereof.

At step 5002 the enquiry is made as to whether the coolant level in the coolant jacket is lower than that of sensor 140 (II). If so, pump 136 is energized. It will be noted that although the engine as a whole may be subject to excessive cooling, it is necessary to securely maintain the cylinder head sufficiently immersed in coolant to avoid thermal damage to same. If the level is determined to be adequately high, the program proceeds to step 5005 wherein the pump is stopped.

At step 5006 it is determined if the coolant level in the radiator 126 has fallen due to a temperature increase and attendant pressure increase (which displaces the coolant inducted by the negative pressure) to the level of sensor 130 viz,. sensor (I). If not, then the program recycles to step 5002. However, if the level of coolant has lowered to that of level sensor 130 (I) due to a pressure increase, the program goes on to step 5007 wherein the temperature of the coolant is sampled. If the temperature is above 100° C. then the program proceeds to step 5008 valve 156 (1) is closed to return the system to a fully closed state. However, if the temperature as yet has not exceeded 100° C. then the program recycles to step 5002.

Upon closure of valve 156 (1) (step 5008) then the program returns to step 4003 of the normal operation routine.

When the engine being stopped, as the temperature of the coolant is inevitably at or above 100° C., a sudden return to an "open" state would permit the positive pressure to suddenly discharge rather large quantities of the liquid coolant within the system out to the reservoir 146. While this situation can be handled by using a voluminous reservoir having a capacity greater than the volume of the cylinder block, raditator and associated conduiting, it is preferred to reduce the size of the reservoir from the view points of saving both space and weight. Accordingly, upon the engine being stopped (via opening of the ignition switch) the system shutdown sub routine is implemented.

In this routine the opening of the ignition switch is detected at step 6001. At step 6002 the valves with the exception of valve 134 (2) are condition to assume closed positions. At step 6003, the 6003 program allows for the temperature to fall to 97° C. (for example) before proceeding. Viz., at step the enquiry is made as to whether the temperature of the coolant is less than the aformentioned temperature (97° C.). If the answer is NO the program recycles until the result is positive. At step 6004 valve 156 (1) is de-energized and allowing to open. As a result, the now negative pressure which prevails within the system inducts coolant from the reservoir 146 into the radiator 126. This tends to flush the radiator out and ensure that no fing air bubbles or the like remain therein and force same (if present) to move toward and into the riser 162 ready for purging. As the system is essentially free of non-condensible matter the system becomes completely filled upon the coolant vapor completely condensing.

Figure 16:
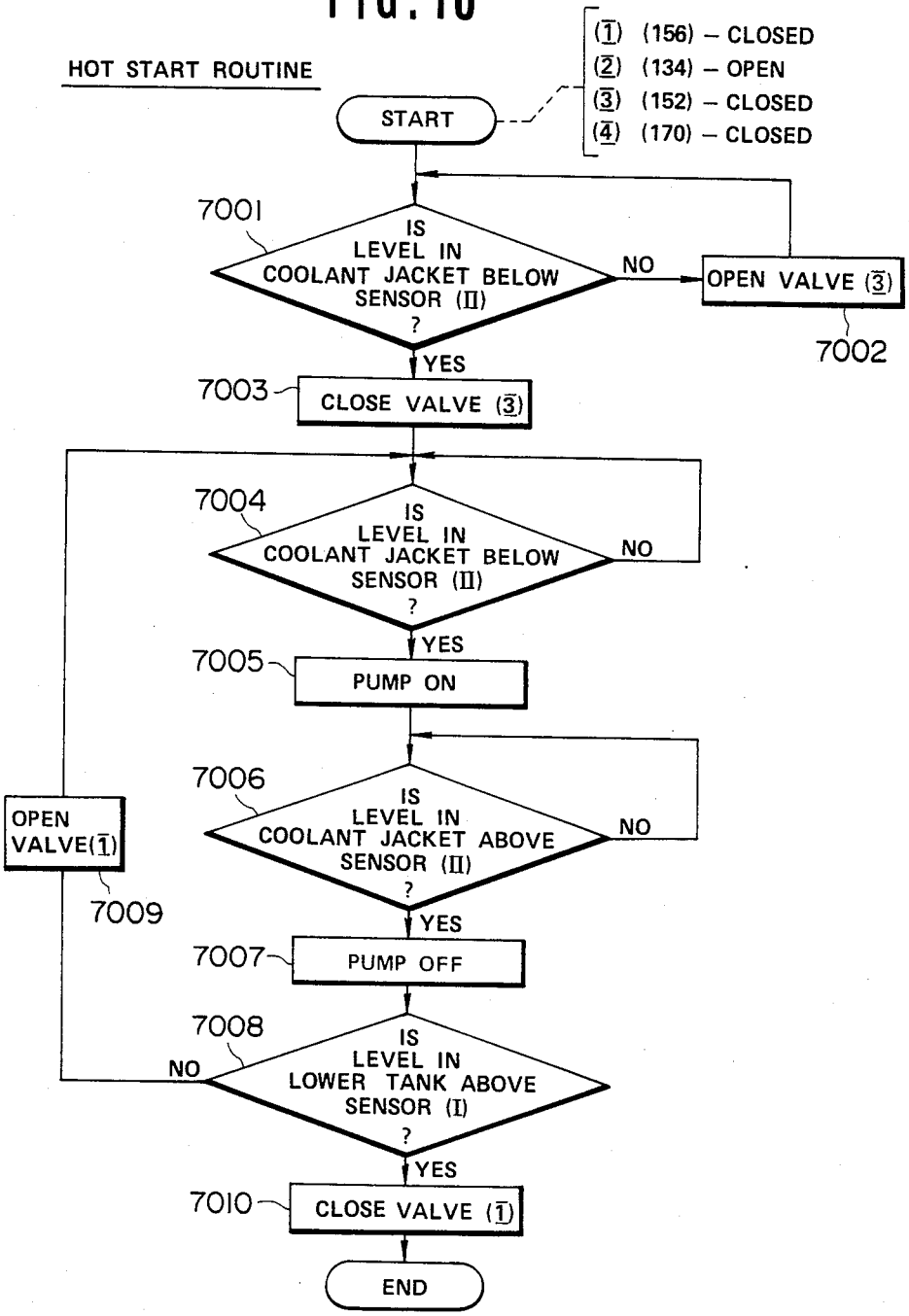

FIG. 16 shows a steps which are implemented should the engine be started up again after only a brief stop. As will be appreciated the system status program will be run and as the temperature of the engine will be above 45° C. after only a momentary stop, the program will proceed via steps 1001 and 1005 to implement the hot start routine.

At the begining of the hot start routine, the valves are (i.e. have been) conditioned as shown. Viz., all valve with the exception of valve 156 (1) are closed.

At step 7001, it is determined if the coolant level in the coolant jacket is below that of sensor 140 (II). If the annser is NO then valve 152 (3) is opened. Accordingly, at this time any excess coolant which may have been permitted to enter the system during the execution of the system shut-down routine fo example, is displaced as the temperature of the coolant rises (increasing the vapor pressure within the system) out through valve 152 (3). Upon the level of coolant reaching that of level sensor 140 (II) the valve 152 is closed (step 7003). Next, at step 7004, it is ascertained if the level of the coolant in the coolant jacket is below sensor 140 (II). If the level is lower, then the pump 136 is switched on (step 7005). However, if an adequate level of coolant is present in the coolant jacket then the program recycles. At step 7006 it is determined if the coolant level in the coolant jacket is above level sensor 140 (II). If not the program recycles and awaits the level to rise to sensor 140 under the influence of the operation of pump 136 (energized in step 7005). Upon the level rising to that of sensor 140, the program proceeds to stop the pump 136 (step 7007) and to determine (step 7008) if the level of coolant in the radiator 126 has fallen to that of level sensor 130 disposed in the lower tank 128. If not the program recycles to await this phenomenon. When the quantity of coolant in the system has been reduced to the appropriate volume, valve 156 (1) is closed and the program returns to step 1007 (FIG. 10).

Although the disclosed embodiment of the invention is such that conduit 154 communicates with conduit 132 at a location intermediate of the pump 136 and valve 134, it will be appreciated that various modifications may be made including connecting conduit 156 directly to the lower tank 128 or to conduit 132 at a loccation intermediate of the lower tank 128 and the valve 134.

What is claimed is:

1. In an internal combustion engine having a combustion chamber;

a radiator;

a coolant jacket in which coolant is boiled and the vapour produced fed to said radiator for condensation therein;

a reservoir containing coolant;

a first conduit leading from said radiator to said coolant jacket, said first conduit including a pump for returning liquid coolant from said radiator said said coolant jacket and a first valve, said first valve having an open position wherein fluid can flow therethrough and a closed position wherein fluid is prevented from passing therethrough to said coolant jacket;

a second conduit which communicates with said reservoir at one one end thereof and which communicates with said coolant jacket at the other end thereof, said second conduit including a second valve having an open position and a closed position;

a third conduit which communicates at one end thereof with said reservoir and which communicates at the other end thereof with one of said radiator and said first conduit at a location between said pump and said radiator, said third conduit including a third valve, said third valve having an open position and a closed position; and a control circuit for controlling the operation of said pump, first, second and third valves.

2. An engine as claimed in claim 1, further comprising a fourth conduit which leads from the highest point of one of said coolant jacket and said radiator to said reservoir, said fourth conduit including a fourth valve therein which controls fluid communication between said reservoir and said highest point of said one of said coolant jacket and said radiator.

3. An engine as claimed in claim 2, further comprising a first level sensor, said first level sensor being disposed in said coolant jacket at a first predetermined level which is higher than said combustion chamber, said contol circuit being responsive to the output of said first level sensor in a manner to energize said pump in manner which maintains the level of liquid coolant in said coolant jacket at said first level.

4. An engine as claimed in claim 3, further comprising:

a temperature sensor, said temperature sensor sensing the temperature of the liquid coolant in said coolant jacket; and a device for varying the rate of condensation of the coolant vapour in said radiator;

said control circuit being responsive to said temperature sensor in a manner to induce said device to increase the rate of condensation in said radiator upon the temperature of the liquid coolant within said coolant jacket exceeding a target level.

5. An engine as claimed in claim 4, further comprising a small tank at the bottom of said radiator for collecting condensed coolant; and a second level sensor disposed in said tank for sensing the level of liquid coolant at a second predetermined level.

6. An engine as claimed in claim 5, further comprising a third level sensor, said third level sensor being disposed at said highest point of said one of said coolant jacket and said radiator and arranged to indicate the level of liquid coolant reaching same when the engine is stopped.

7. An engine as claimed in claim 6, wherein said control circuit includes a microprocessor, said microprocessor being arranged to receive data inputs from said first, second and third level sensors and said temperature sensor, said microprocessor being arranged to, in accordance with the inputs, operate said pump, said device and said first, second, third and fourth valves in manner to perform:

a non-condensible matter purge operation wherein excess coolant is pumped into said coolant jacket and said radiator to the point of overfilling same and thus displacing any non-condensible matter out through said fourth valve and said fourth conduit;

a cold start operation wherein excess coolant in said coolant jacket and said radiator are displaced out to said reservoir by the pressure developed when said coolant is heated by the heat produced when the engine operates;

a normal operation wherein said coolant jacket and radiator are fluidly separated from said reservoir and said device is controlled in a manner to control the rate of condensation in said radiator and thus control the pressure within said coolant jacket and radiator in a manner to control the boiling point of said coolant;

an overcooled control operation wherein, if the engine becomes excessively cooled, said radiator is partially filled with liquid coolant to reduce the amout of heat which may be released to the ambient atmosphere by said radiator; and a system shutdown operation wherein the coolant in said coolant jacket is allowed to cool before communication between said reservoir and said coolant jacket is established whereby a negative pressure which develops in said coolant jacket and radiator inducts coolant from said reservoir and fills said coolant jacket and radiator with liquid coolant.

* * * * *